US009758991B2

(12) United States Patent
Lin et al.

(10) Patent No.: US 9,758,991 B2
(45) Date of Patent: Sep. 12, 2017

(54) LOCK WITH WATER-RESISTANT TOUCH KEYPAD

(71) Applicant: Spectrum Brands, Inc., Middleton, WI (US)

(72) Inventors: James Lin, Laguna Niguel, CA (US); Byron Quach, West Covina, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 14/918,656

(22) Filed: Oct. 21, 2015

(65) Prior Publication Data

US 2016/0115713 A1 Apr. 28, 2016

Related U.S. Application Data

(60) Provisional application No. 62/069,402, filed on Oct. 28, 2014.

(51) Int. Cl.

| | |
|---|---|
| ***F21V 31/00*** | (2006.01) |
| ***E05B 47/00*** | (2006.01) |
| ***E05C 1/08*** | (2006.01) |
| ***E05B 17/10*** | (2006.01) |
| *F21V 23/04* | (2006.01) |

(52) U.S. Cl.

CPC ..... *E05B 47/00* (2013.01); *E05B 17/10* (2013.01); *E05C 1/08* (2013.01); *F21V 23/0485* (2013.01); *H01H 2219/056* (2013.01)

(58) Field of Classification Search

CPC . E05B 47/00; E05C 1/08; E02B 17/10; F21V 23/0485; F21V 23/0442; G06F 3/0202; H04M 1/22; G05B 1/105; H01H 2219/056; H01H 13/705

See application file for complete search history.

(56) References Cited

U.S. PATENT DOCUMENTS

| | | | |
|---|---|---|---|
| 5,268,634 | A | 12/1993 | Batcher |
| 5,611,226 | A | 3/1997 | Fata |
| 6,011,961 | A | 1/2000 | Kaschke |

(Continued)

FOREIGN PATENT DOCUMENTS

| | | | |
|---|---|---|---|
| CN | 203008533 | U | 6/2013 |
| FR | 2804389 | A1 | 8/2001 |

(Continued)

OTHER PUBLICATIONS

PCT International Search Report and the Written Opinion; Feb. 11, 2016.

*Primary Examiner* — Y M. Lee

(74) *Attorney, Agent, or Firm* — Barnes & Thornburg LLP

(57) ABSTRACT

An electronic lock with a latch assembly, an interior assembly and an exterior assembly. The latch assembly includes a bolt movable between an extended position and a retracted position. The interior assembly is configured to move the bolt between the extended position and the retracted position. The exterior assembly includes a touch keypad subassembly configured to detect touches to at least a portion of its surface. The touch keypad subassembly defines an opening through which a wiring harness extends. The opening in the touch keypad subassembly is sealed, at least in part, by an epoxy resin and/or internal structure of the touch keypad subassembly.

22 Claims, 14 Drawing Sheets

(56) References Cited

U.S. PATENT DOCUMENTS

| | | | | |
|---|---|---|---|---|
| 6,608,271 | B2 | 8/2003 | Duarte | |
| 6,760,964 | B1 | 7/2004 | Gartner | |
| 7,271,862 | B2 | 9/2007 | Matsunaga et al. | |
| 7,398,114 | B2 | 7/2008 | Gartrell | |
| 2002/0056300 | A1 | 5/2002 | Pierre et al. | |
| 2003/0111366 | A1 | 6/2003 | Enners | |
| 2004/0022573 | A1 | 2/2004 | Yamauchi et al. | |
| 2009/0200950 | A1* | 8/2009 | Jensen | F21V 23/0442 315/113 |
| 2010/0257906 | A1* | 10/2010 | Sorensen | E05B 47/068 70/91 |
| 2011/0226023 | A1 | 9/2011 | Freeman | |
| 2012/0133862 | A1 | 5/2012 | Cho et al. | |
| 2012/0199459 | A1 | 8/2012 | Reise | |
| 2013/0027861 | A1 | 1/2013 | Rosenau | |
| 2013/0107495 | A1 | 5/2013 | Park | |
| 2013/0208441 | A1 | 8/2013 | Kim | |
| 2013/0233689 | A1 | 9/2013 | Ng | |
| 2014/0265359 | A1 | 9/2014 | Cheng et al. | |

FOREIGN PATENT DOCUMENTS

| | | | |
|---|---|---|---|
| JP | 2009062740 | A | 3/2009 |
| JP | 2009155933 | A | 7/2009 |
| JP | 03159984 | U | 6/2010 |
| KR | 873984 | B1 | 12/2008 |
| KR | 445519 | Y1 | 8/2009 |
| KR | 10-2011-0065890 | A | 6/2011 |

* cited by examiner

LOCK WITH WATER-RESISTANT TOUCH KEYPAD

RELATED APPLICATIONS

This application claims priority to U.S. Provisional Application Ser. No. 62/069,402 filed Oct. 28, 2014, which is hereby incorporated by reference in its entirety.

TECHNICAL FIELD

This disclosure relates generally to electrical and electromechanical locks; in particular, this disclosure relates to a water-resistant touch keypad for a lock.

BACKGROUND

Electronic deadbolts are well known. Indeed, electronic deadbolts have become increasingly popular for securing access in both residential and commercial settings. Many electronic deadbolts include a keypad that allows users to enter a passcode to unlock the lock. In some cases, the keypads have physical buttons that the users press to enter passcodes while others include touch buttons that operate on capacitive touch. With touch buttons, the keypad is able to sense touches of the user's finger on the keypad surface without the mechanical parts of a physical button.

Even though these types of locks contain electronics, they are often installed outside, such as to secure an entry door to a building. With such an installation, the locks can be subject to a harsh environment that includes rain, sleet, and snow. Moreover, rapid temperature fluctuations outdoors can cause condensation on the locks. If moisture penetrates the lock to the electronics, this can cause a failure of lock operation using the keypad. Therefore, there is a need for a novel water-resistant assembly for an electronic deadbolt.

SUMMARY

This disclosure relates to a water-resistant touch keypad for use with an electronic deadbolt. The electronic deadbolt includes a latch assembly including a bolt movable between an extended position and a retracted position. An interior assembly is provided that is configured to move the bolt between the extended position and the retracted position. The lock has an exterior assembly that is also configured to move the bolt between the extended position and the retracted position. The exterior assembly includes a water-resistant touch keypad subassembly. In some embodiments, the touch keypad assembly includes a touch overlay including a plurality of touch areas. A touch circuit is provided that is configured to detect touches on the touch overlay. A plurality of LEDs are arranged to correspond with the touch areas on the touch overlay. The exterior assembly includes a wiring harness configured to be electrically connected with a circuit on the interior assembly. A screen holder is provided with a recessed area dimensioned to receive at least a portion of the touch circuit. The screen holder includes an opening dimensioned to receive the wiring harness. The touch keypad subassembly includes a diffuser assembly with a diffuser formed from a translucent material configured to diffuse light emanating from the LEDs. The diffuser assembly includes a resilient portion configured to urge at least a portion of the touch circuit towards the screen holder.

In some embodiments, the diffuser assembly includes a spacer formed from a generally opaque material that is disposed between the diffuser and the LEDs. In some cases, the spacer includes a plurality of holes arranged to correspond with the LEDs Embodiments are contemplated in which the spacer includes resilient flanges extending from the openings that urge at least a portion of the touch circuit towards the screen holder. Typically, the resilient flanges would also urge the diffuser towards the touch overlay. In some embodiments, the opening in the screen holder is filled with an epoxy resin to seal the opening.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 2:
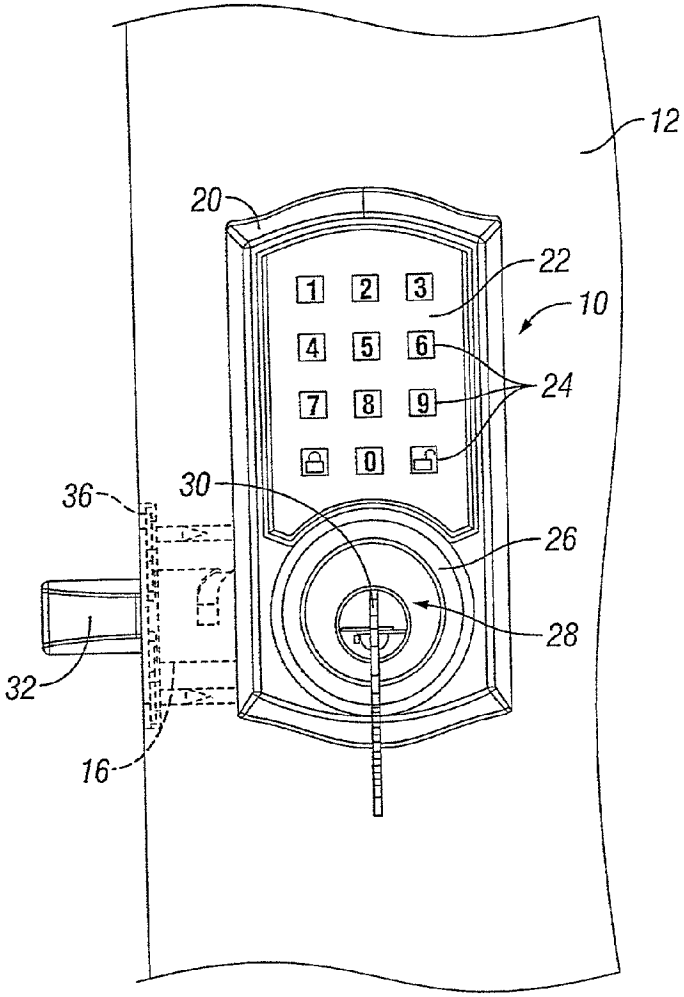
FIG. 2 is a front view of the example exterior assembly shown in FIG. 1.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

This disclosure relates to a water-resistant touch keypad for use with an electronic deadbolt. The term "electronic deadbolt" is broadly intended to encompass electromechanical locks with a bolt that is moved between a locked and unlocked position electronically and/or mechanically, including but not limited to single cylinder, double cylinder, and vertical deadbolts.

Figure 1:
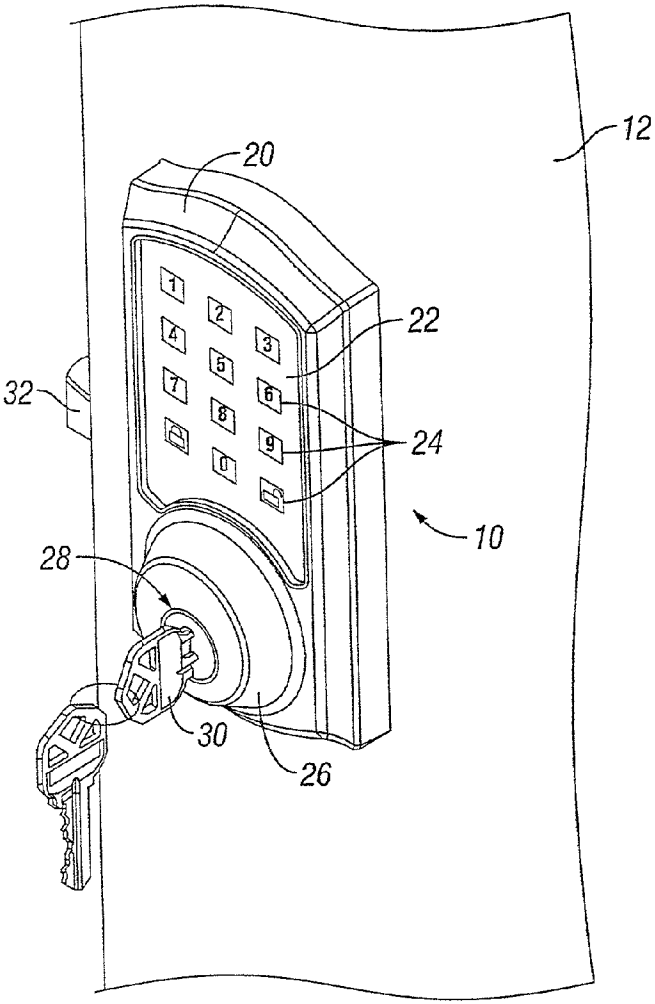
FIG. 1 is a front perspective view of an example exterior assembly according to an embodiment of this disclosure.

FIG. 1 shows an exterior assembly 10 of an electronic deadbolt assembly according to one embodiment of the disclosure. Typically, the exterior assembly 10 is mounted on the outside of a door 12 while an interior assembly 14 (FIG. 4) is mounted inside the door 12. The term "outside" is broadly used to mean an area outside a door and "inside" is also broadly used to denote an area inside a door. With an exterior entry door, the exterior assembly 10 may be mounted outside a building where it is subject to harsh weather conditions, while the interior assembly 14 may be mounted inside the building. With an interior door, the exterior assembly 10 may be mounted inside a building, but outside a room secured by the deadbolt assembly. The interior assembly 14 may be mounted inside the secured room. The deadbolt assembly discussed herein is applicable to both interior and exterior doors; however, the environment to which exterior doors are subjected, such as rain, snow, sleet and temperature swings, is particularly suited to the water-resistant feature of the touch keypad described herein.

In the example shown, the exterior assembly 10 has a rose 20 or decorative cover that surrounds the perimeter to the exterior assembly 10. As shown, the rose 20 has a generally rectangular shape, but round, square, and other shapes for the rose 20 are within the scope of this disclosure. The rose 20 could be formed from metal or plastic depending on the circumstances. In the example shown, the rose 20 defines an opening through which a touch keypad 22 is accessible.

The touch keypad 22 has a plurality of touch areas that use touch to function as buttons 24 for entering a passcode for unlocking the deadbolt assembly or otherwise controlling operation. For example, the touch keypad could use a capacitive touch circuit. In the example shown, there are twelve touch areas or buttons 24, but one skilled in the art should appreciate that there could be more than twelve touch areas or less than twelve touch areas depending on the circumstances. For example, touch areas could be used for multiple key inputs, such as touching a button once for "1" and twice for "2," etc. In this example, the touch keypad 22 does not have mechanical keys, but has touch areas or buttons 24 on the touch keypad that allow an uninterrupted surface for the touch keypad 22.

A cylinder guard 26 extends from the rose 20 to protect and reinforce a mechanical lock assembly 28. A mechanical key 30 may be inserted into the mechanical lock assembly 28 to mechanically lock/unlock the deadbolt assembly. Accordingly, in the embodiment shown, the exterior assembly 10 may be used to unlock the deadbolt assembly either electronically using the touch keypad 22, or mechanically using a mechanical key 30.

A latch assembly 16 is disposed in a bore 18 and the door 12 (FIG. 3) and may be actuated manually by the mechanical lock assembly 28, or electronically using the touch keypad 22 to extend and retract a bolt 32. The bolt 32 moves linearly in and out of a sleeve 34. When the bolt 32 is retracted, the end of the bolt 32 is generally flush with a face plate 36. When the bolt 32 is extended, the bolt 32 protrudes through an edge bore in the door 12 into an opening of a strike plate (not shown), which is positioned in a jamb adjacent the door 12.

Figure 3:
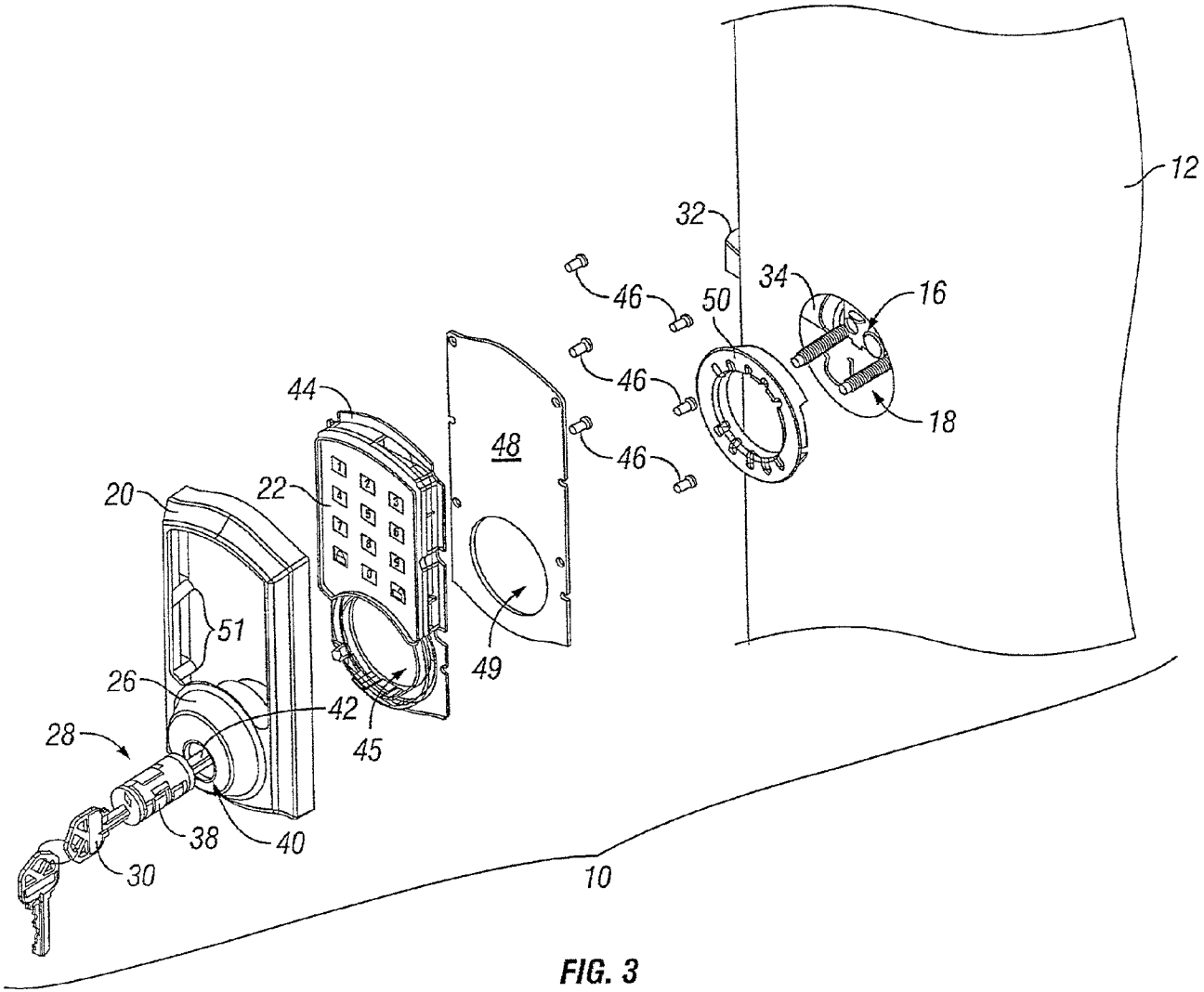
FIG. 3 is an exploded view of the example exterior assembly shown in FIG. 1.

FIG. 3 is an exploded view of the exterior assembly 10 according to the embodiment shown in FIGS. 1 and 2. As shown in this example, the mechanical lock assembly 28 includes a cylinder 38 that extends into an opening 40 defined by the cylinder guard 26. To mechanically lock/unlock the bolt 32 with the mechanical lock assembly 28, the user would insert the mechanical key 30 into a keyhole defined in the cylinder 38 and rotate the cylinder 38, which rotates a torque blade 42. The torque blade 42 interacts with the latch assembly 16 to extend/retract the bolt 32.

In the example shown, the touch keypad 22 is attached to a screen holder 44. The screen holder 44 includes an opening 45 that receives a rear portion of the mechanical lock assembly 28. The screen holder 44 is coupled between the rose 20 and a back plate 48. The back plate 48 also includes an opening 49 that receives a rear portion of the mechanical lock assembly. As shown, a plurality of fasteners 46 secure the back plate 48 to the rose 20. In the embodiment shown, holes in the back plate 48 and screen holder 44 are aligned with threaded openings 51 in the rear portion of the rose 20. An adapter 50 is aligned with the bore 18 in the door 12 and has an opening dimensioned to receive the torque blade 42 and wiring harness 102 (FIG. 13) extending from the touch keypad 22 to the interior assembly 14. The wiring harness 102 allows touches received from the touch keypad 22 to be communicated to a controller circuit disposed in the interior assembly 14 for controlling the locking/unlocking of the deadbolt.

Figure 4:
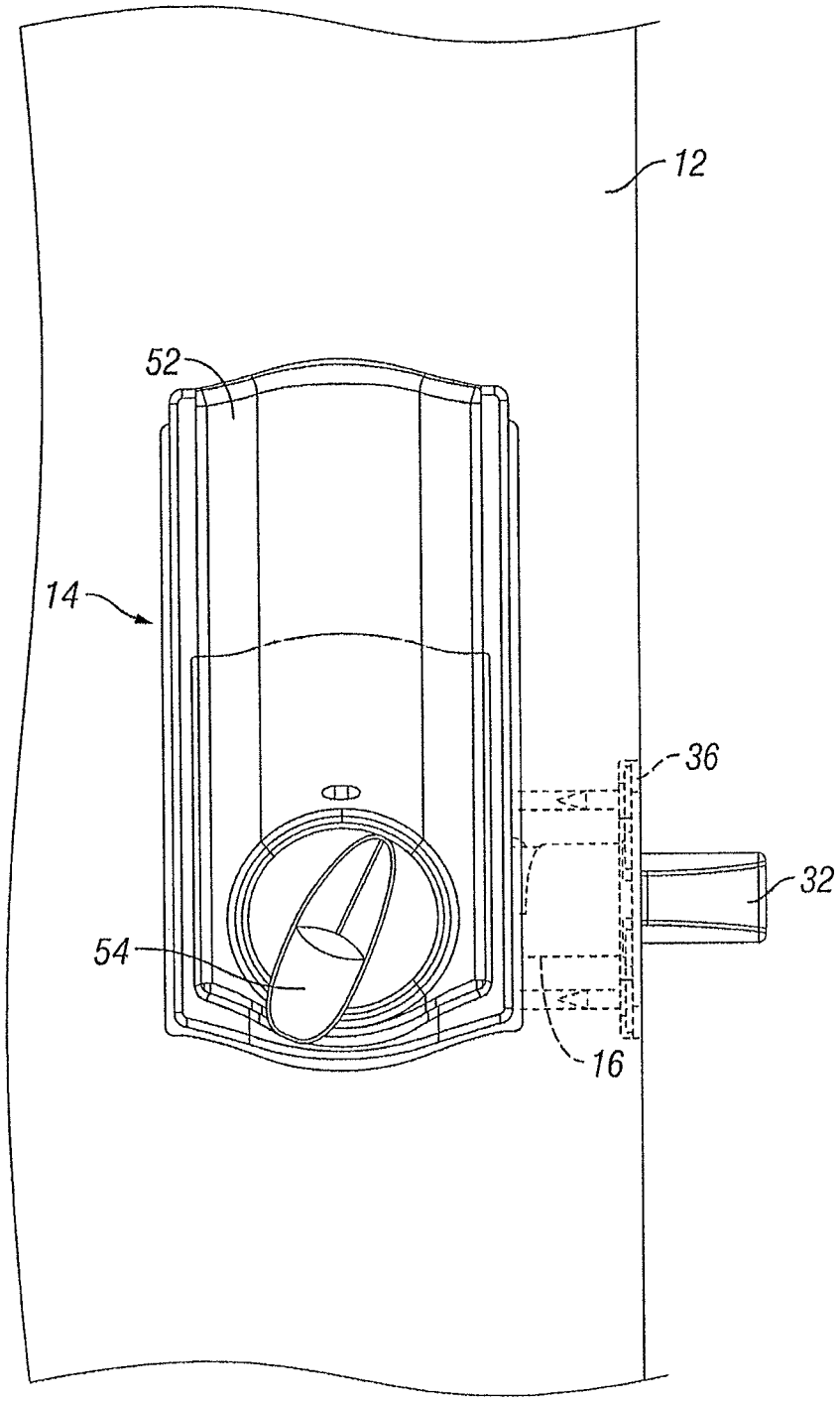
FIG. 4 is a front view of an example interior assembly according to an embodiment of this disclosure.

FIG. 4 shows a front view of an example interior assembly 14. The interior assembly includes a cover 52 that houses internal components of the internal assembly 14. A turn piece 54 may be rotated by user to manually extend and retract the bolt 32. An example device that could be used as the interior assembly to control the operation of the deadbolt is described in U.S. Pre-Grant Publication No. 2014/0250956 filed Feb. 25, 2014, for an "Electronic Deadbolt" which is incorporated by reference herein.

Figure 5:
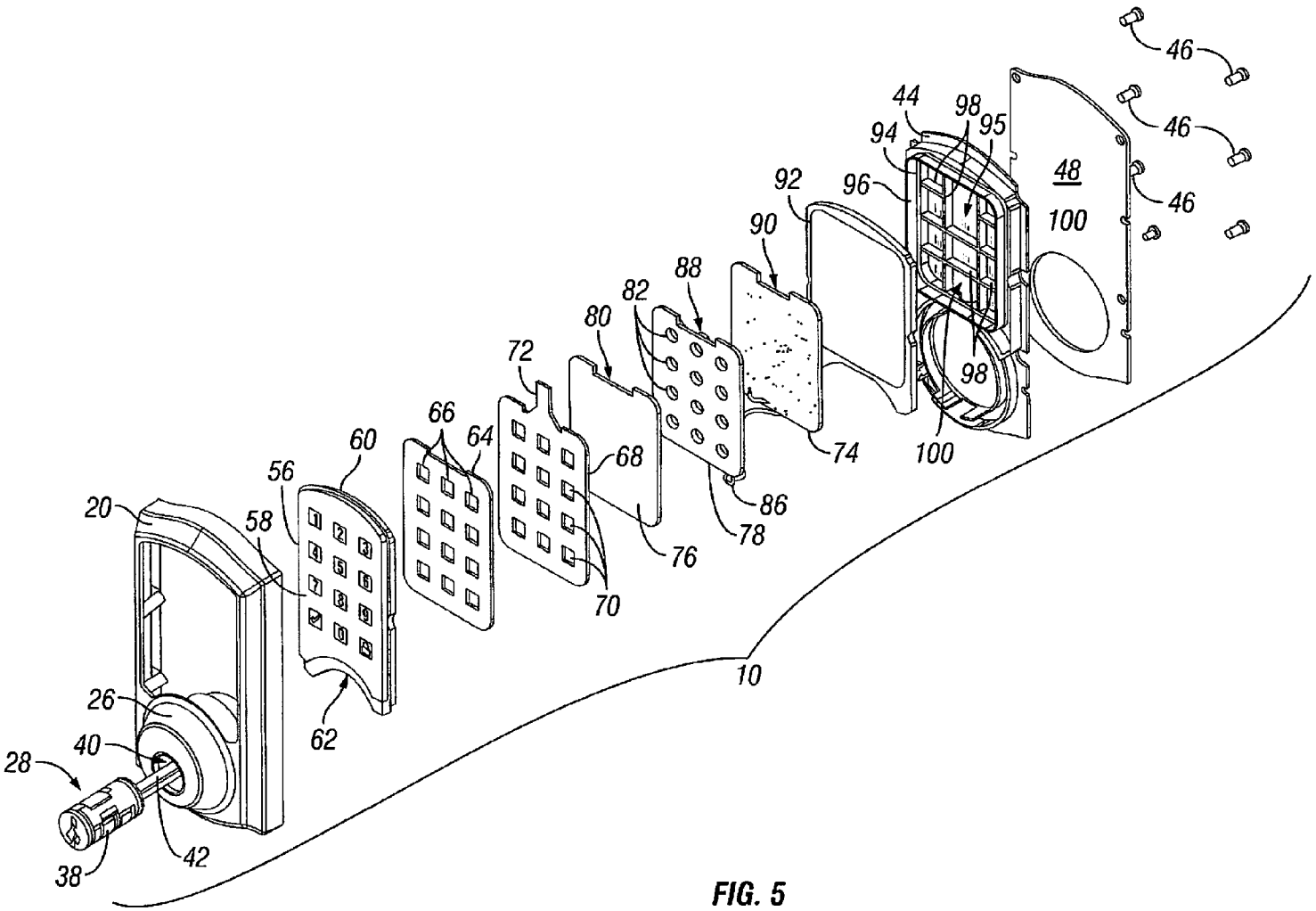
FIG. 5 is an exploded view of the example exterior assembly shown in FIG. 1.
Figure 6:
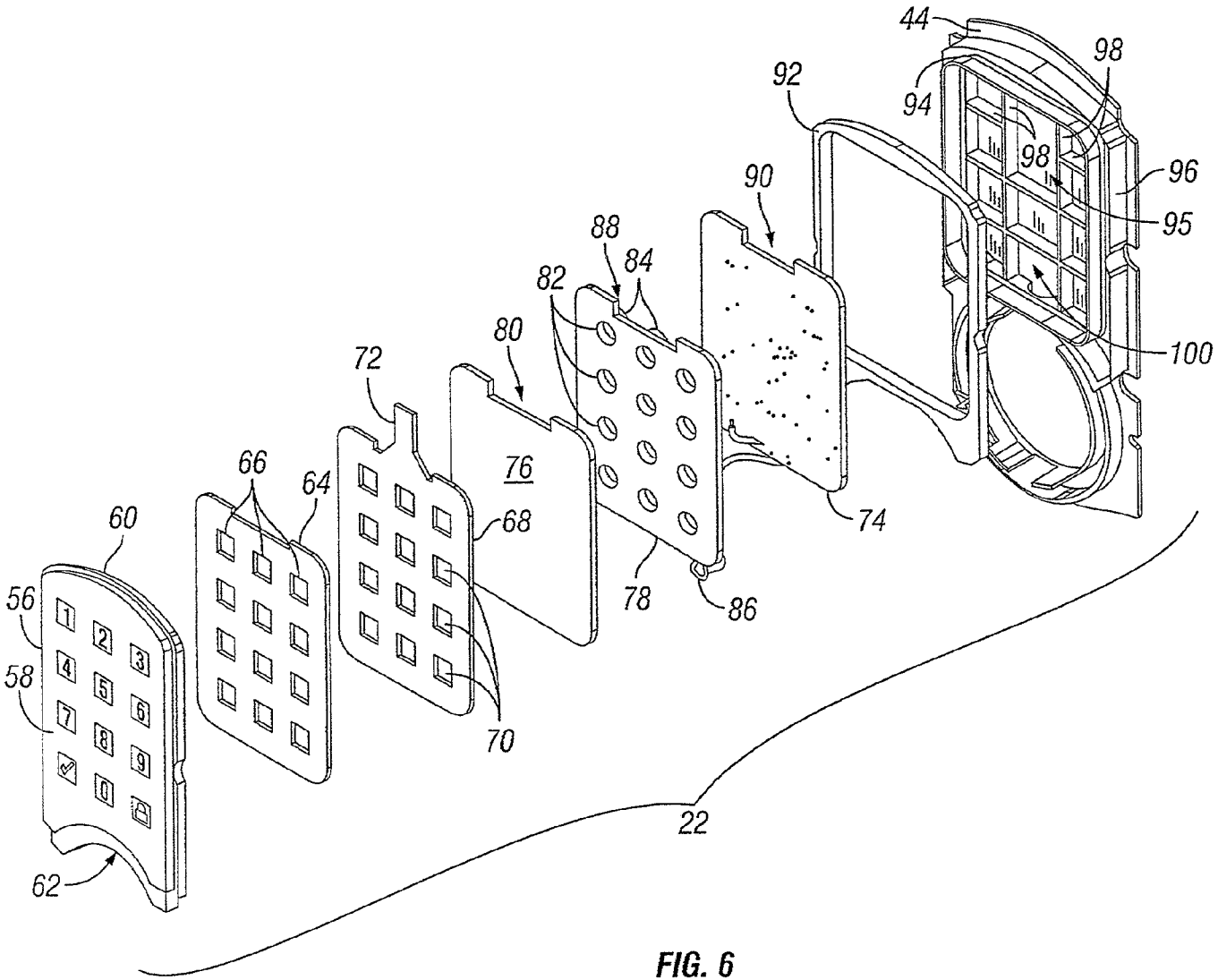
FIG. 6 is an exploded view of the touch keypad subassembly according to an embodiment of this disclosure.

Referring to FIGS. 5 and 6, there is shown an exploded view of the exterior assembly 10 (FIG. 5) and the touch keypad sub-assembly 22 (FIG. 6). In the example shown, the touch keypad sub-assembly 22 includes a touch overlay 56 that the user would touch to input a passcode or otherwise operate the deadbolt through the touch keypad. In the example shown, the touch overlay 56 includes a raised surface 58 and an outer flange 60 that is received in the opening in the rose 20.

In some embodiments, the touch overlay 56 could be formed from a polycarbonate, acrylic, or other material. Embodiments are contemplated in which the user would not be able to see the numbers on the front of the touch overlay when the LEDs are turned off. The numbers would only appear when the user touched the front surface of the touch overlay 56 or otherwise activated the touch keypad 22. In some cases, the back of the touch overlay could be coated (e.g., spray painted) with a matte black paint and the numbers laser etched from the back of the touch overlay. A translucent black paint could then be applied on top of the etched area of the numbers to hide the numbers when the LEDs are in the off mode. In some cases, the front surface of the touch overlay could have a scratch resistant coating. In the example shown, the lower portion of the touch overlay 56 has an arcuate portion 62 that generally conforms with the back of the cylinder guard 26.

An adhesive sheet 64 may be received by the back of the touch overlay 56. The adhesive sheet 64 includes a plurality of openings 66 to allow light from the LEDs to illuminate the etched portions of the touch overlay 56. The adhesive sheet 64, in one example, could be purchased from 3M of St. Paul, Minn. under the name 55261 Acrylate Double Coated Tape. The adhesive sheet 64 has adhesive on both sides to attach on one side to the touch overlay 56 and on the other side to a flexible PCB 68.

The flexible PCB 68 allows detection of the user touching the front of the touch overlay 56, such as using a capacitive touch circuit. In the example shown, the flexible PCB 68 includes a plurality of openings 70 through which light may be illuminated from the LEDs to light up the etched areas of the touch overlay 56. As shown, the flexible PCB 68 includes a connector 72 for electrically connecting the flexible PCB circuit 68 to the hard PCB 74. Although the example shown includes a flexible PCB 68 and hard PCB 74, one skilled in the art should appreciate that there are many ways to implement a touch circuit, such as using only a flexible PCB circuit 68, only using a hard PCB 74, a combination as shown, or by integrating the electronics directly into the touch overlay 56.

A diffuser assembly is disposed between the flexible PCB 68 and the hard PCB 74. In the example shown, the diffuser assembly is a two-piece assembly with a light diffuser 76 and a spacer 78. Although a two-piece assembly is shown for purposes of example, a one-piece diffuser assembly could be formed with the resilient feature of the spacer 78 by integrating this feature into the light diffuser 76. As shown, the diffuser 76 is formed from a translucent material that allows light from the LEDs on the hard PCB 74 to illuminate in a diffused manner to the etched portions of the touch overlay 56 to reduce hot spots of lights. The diffuser 76 could be formed from a white, silicon rubber, polycarbonate or any other suitable translucent material depending on the color of the buttons on the touch overlay 56 that is desired. As shown, the diffuser 76 includes a notch 80 that is configured to allow the connector 72 of the flexible PCB 68 to pass therethrough.

The spacer 78 includes a plurality of openings 82 that are arranged to correspond with LEDs on the hard PCB 74. In some embodiments, the spacer 78 is made from an opaque, black material, which could be silicone rubber in some embodiments, to block light from illuminating through any areas except the openings 82. In the example shown, a flange 84 (FIG. 9) surrounds each of the openings 82. The flanges 84 are formed from a resilient material to urge the hard PCB 74 against the screen holder 44 and the other components against the rose 20. As shown, the rose 20 includes a threaded opening 51 to which the hard PCB 74 is electrically connected through a wire 86. The spacer 78 includes a notch 88 that is dimensioned to receive the connector 72 from the flexible PCB 68.

The hard PCB 74 includes a circuit for controlling input/output from/to the touch overlay 56 and is electrically connected with the flexible PCB 68 using the connector 72. The hard PCB 74 includes a plurality of LEDs 104 (FIG. 16) spaced apart to correspond with the etched portions of the touch overlay 56. The hard PCB 74 includes a notch 90 for receiving the connector 72 of the flexible PCB 68.

In the example shown, a gasket 92 is provided that is received between an inner ring 94 and an outer ring 96 of the screen holder 44. By way of example, the gasket 92 could be made out of silicone to keep moisture out of the interior portion of the exterior assembly 10 to protect the electronic components. In some cases, the gasket 92 could have an adhesive applied to the top and bottom surfaces to attach between the touch overlay 56 and screen holder 44. Embodiments are contemplated in which the screen holder 44 could be glued to the touch overlay 56 or sonic-weld or other joining method could be used.

The screen holder 44 includes a recessed area 95 that has a perimeter defined by the inner ring 94, which is dimensioned to receive the touch keypad subassembly 22. Ridges 98 extend from the recessed area 95 to provide a platform for holding the hard PCB 74 and other components of the touch keypad subassembly 22. An opening 100 extends through the screen holder 44 that is dimensioned to receive a wiring harness extending from the hard PCB 74. A back plate 48, which could be formed from a metal, is attached to the screen holder using fasteners 46.

Figure 10:
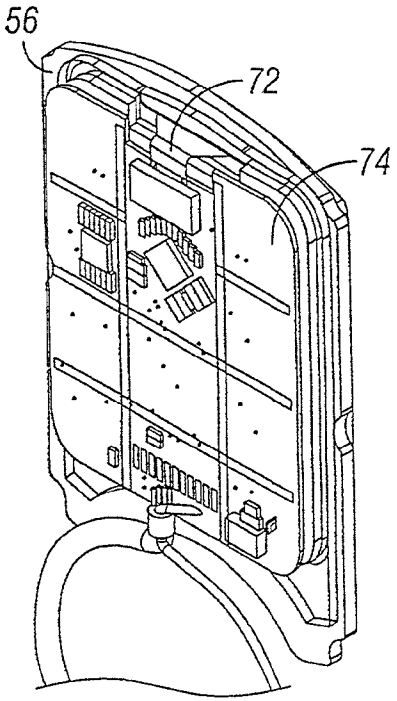
FIG. 10 is a rear view of the partially assembled touch keypad subassembly from FIG. 9 that adds a hard PCB.
Figure 9:
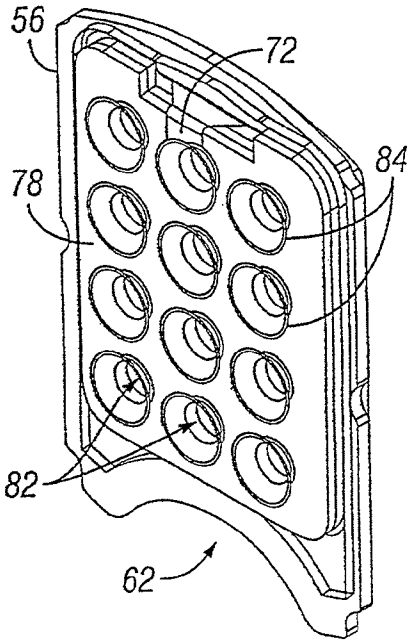
FIG. 9 is a rear view of the partially assembled touch keypad subassembly from FIG. 8 that adds a spacer.
Figure 8:
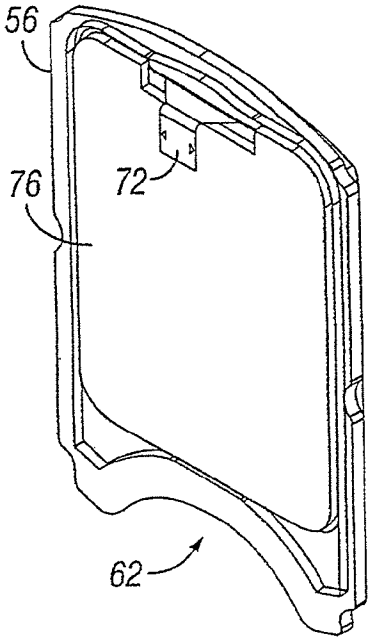
FIG. 8 is a rear view of the partially assembled touch keypad subassembly from FIG. 7 that adds a light diffuser.
Figure 7:
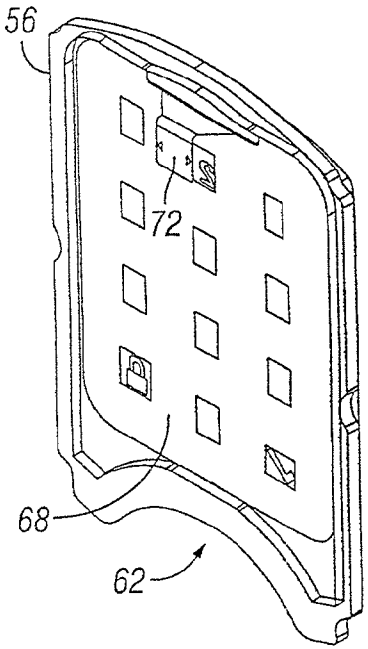
FIG. 7 is a rear view of the touch keypad subassembly that is partially assembled with a touch overlay and flexible PCB according to an embodiment of this disclosure.
Figure 12:
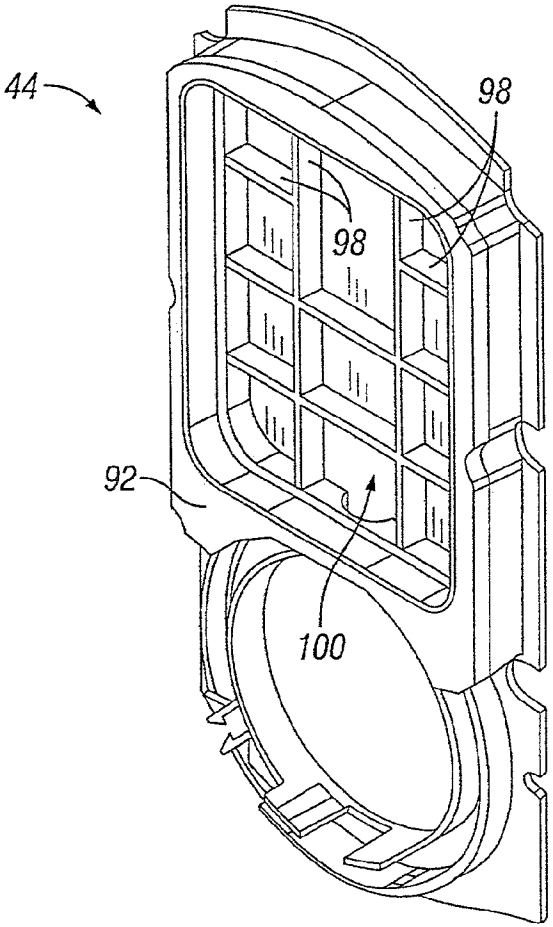
FIG. 12 is a front view of the example screen holder shown in FIG. 11 with a gasket attached.
Figure 11:
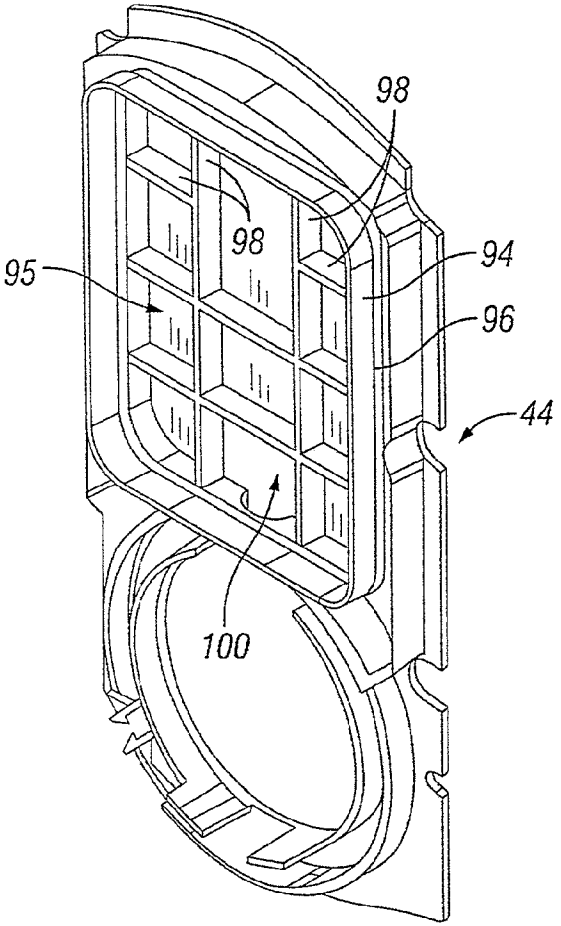
FIG. 11 is a front view of an example screen holder according to an embodiment of the disclosure.
Figure 13:
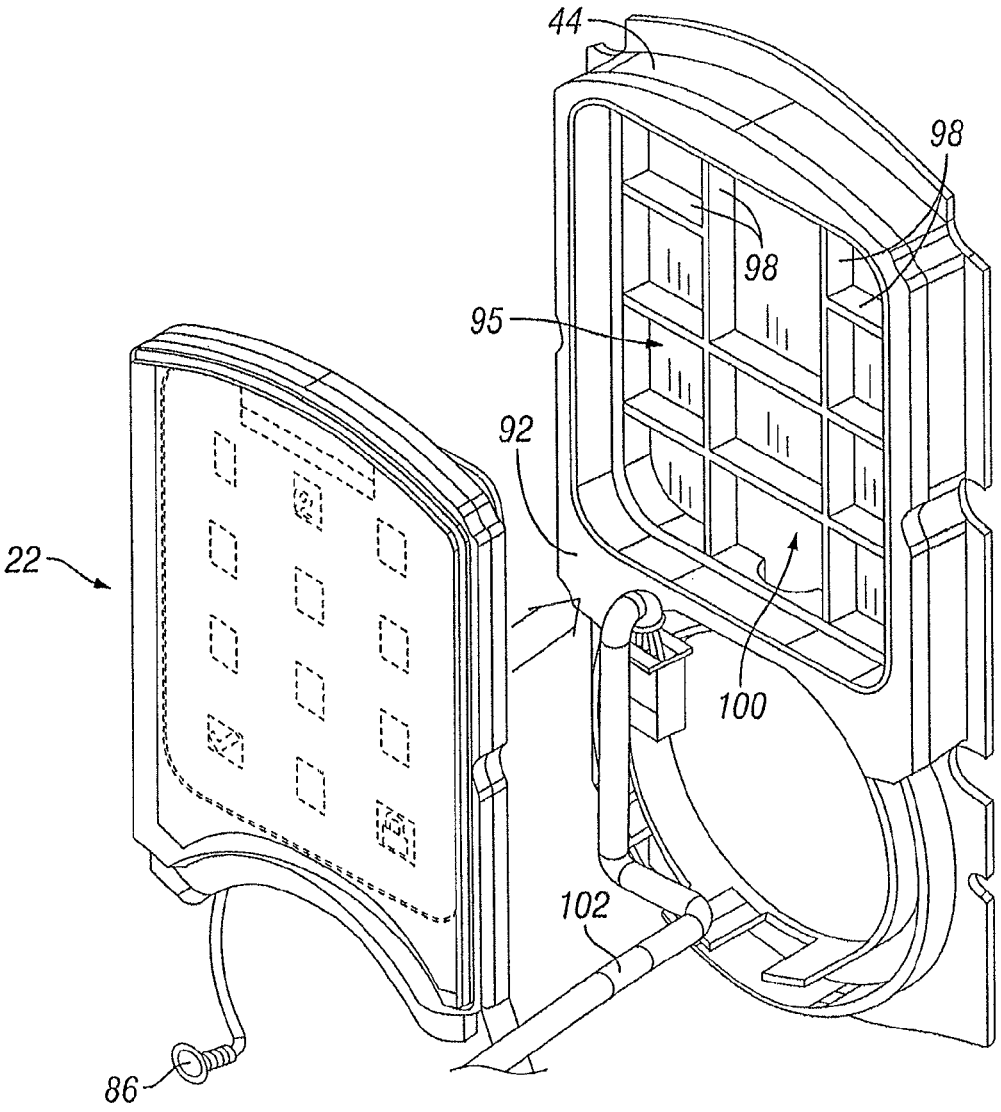
FIG. 13 is a front view of the touch keypad subassembly prior to insertion into the screen holder.
Figure 14:
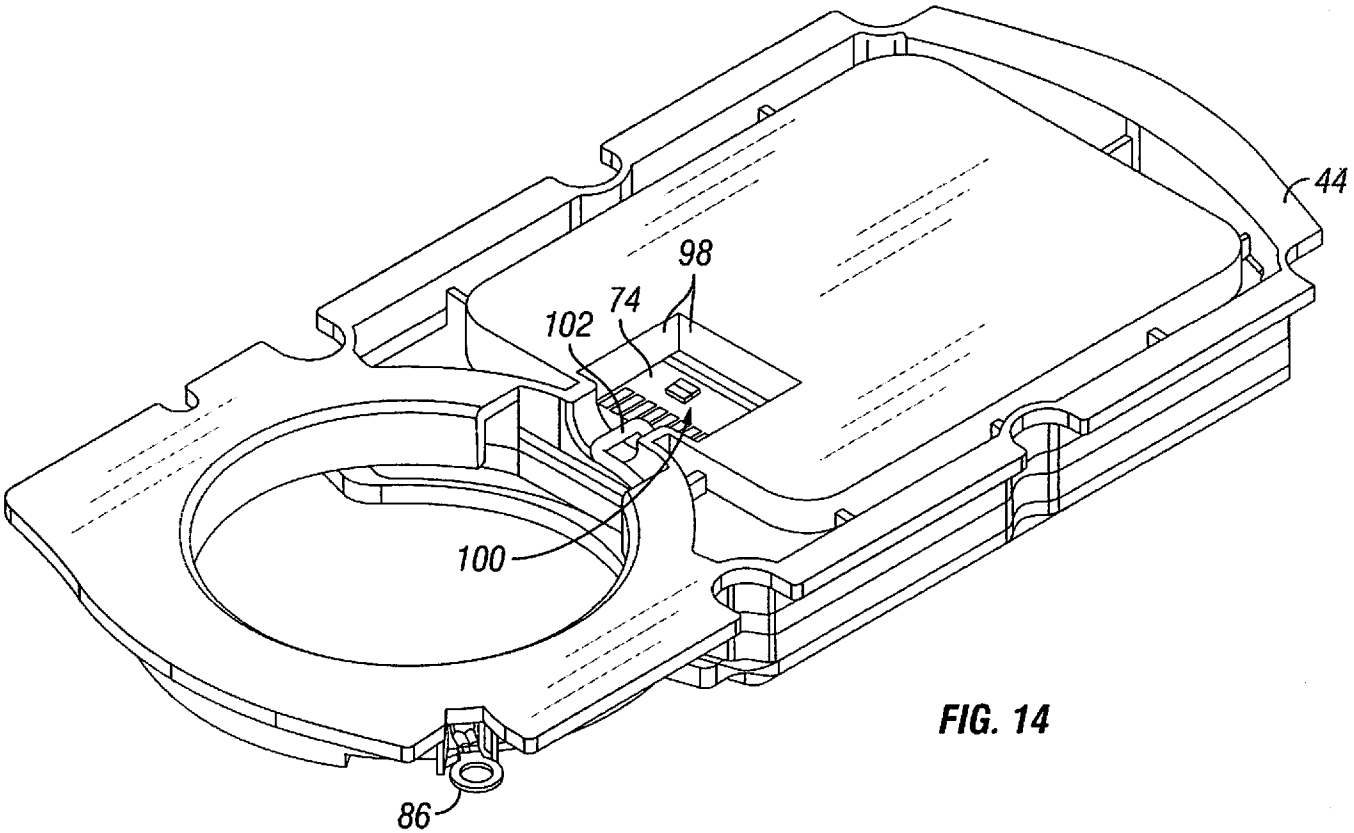
FIG. 14 is a rear view of the screen holder with the touch keypad subassembly inserted therein.
Figure 15:
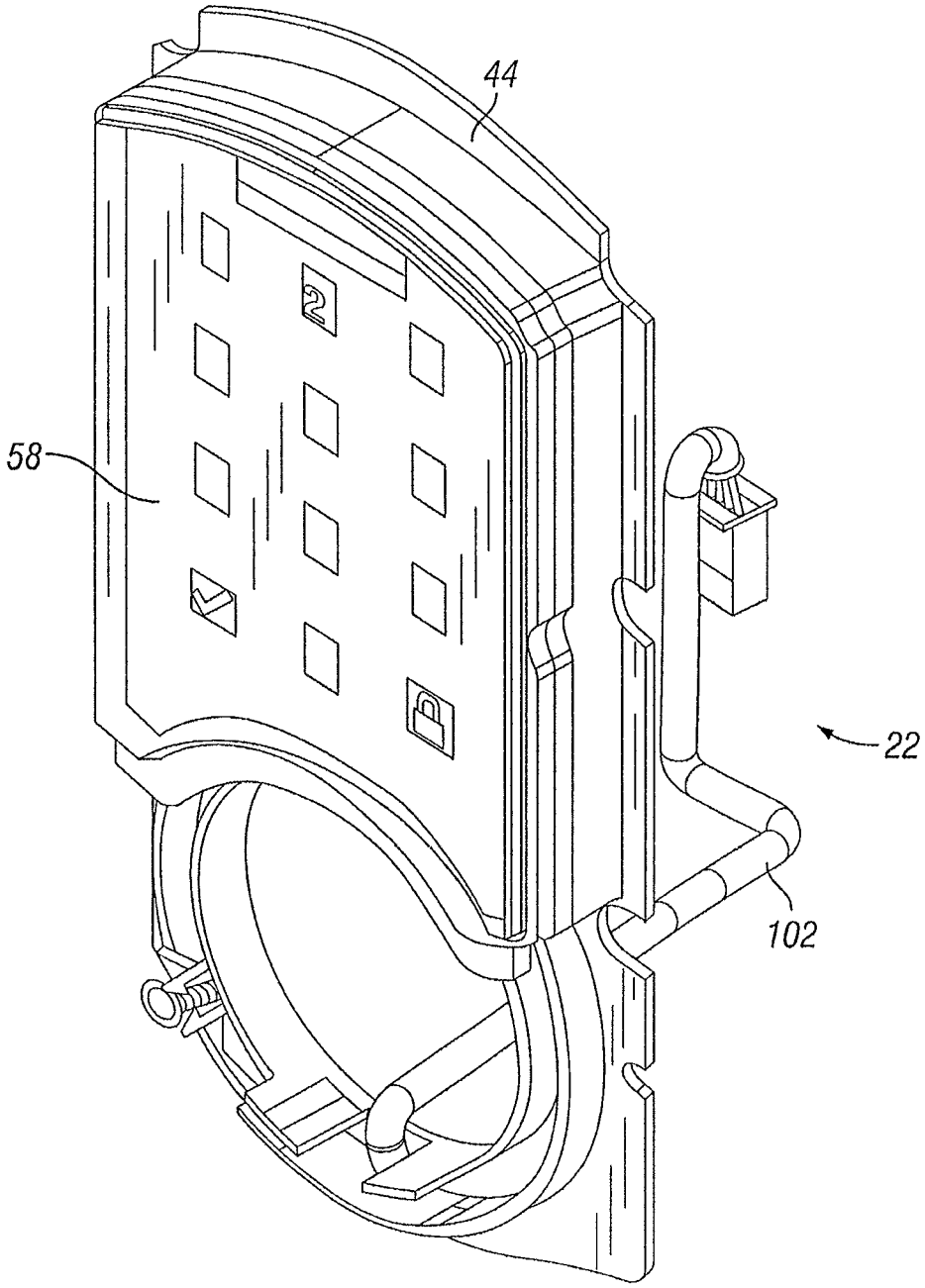
FIG. 15 is a front perspective view of an assembled touch keypad subassembly according to an embodiment of the disclosure.

FIGS. 7-15 show a progression of assembling the exterior assembly 10 according to one embodiment. In FIG. 7, there is shown a rear view of the touch overlay 56 with the flexible PCB 68 attached using the adhesive sheet 64. In FIG. 8, the diffuser 76 has been added behind the flexible PCB 68. FIG. 9 shows the addition of the spacer 78 behind the diffuser 76. The flanges 84 around the openings 82 in the spacer 78 are resilient to provide a spring-like effect to urge the diffuser 76 towards the touch overlay 56 while also urging the hard PCB 74 (when added) against the ridges 98 in the screen holder 44. FIG. 10 shows the addition of the hard PCB 74 behind the spacer 78. FIG. 11 shows a front view of the screen holder 44 prior to inserting the touch subassembly 22 into the recessed area 95. FIG. 12 shows the gasket 92 inserted between the rings 94, 96 of the screen holder 44 to prevent moisture from entering the recessed area 95. As shown in FIG. 13, the touch sub-assembly is then inserted into the recessed area 95 in the screen holder 44. The flanges 84 in the spacer 78 urge the hard PCB 74 against the ridges 98 of the screen holder 44. FIG. 14 shows the rear view of the screen holder 44 with the opening 100 through which the wiring harness extends from the hard PCB 74. Due to the spring-effect of flanges 84, the hard PCB 74 is urged against the ridges 98, which creates a cavity into which an epoxy resin may be applied to seal this portion of the internal components from any moisture. The hard PCB 74 being urged against the ridges 98 by the flanges 84 prevents epoxy resin from flowing to areas other than the cavity. As discussed above, there is a gasket 92 that is disposed between the screen holder 44 and touch overlay 56, which along with the epoxy resin, waterproofs the touch keypad subassembly 22. FIG. 15 shows the assembled touch keypad sub-assembly 22 with the wiring harness 102 that may be plugged into a circuit in the interior assembly 14.

Figure 16:
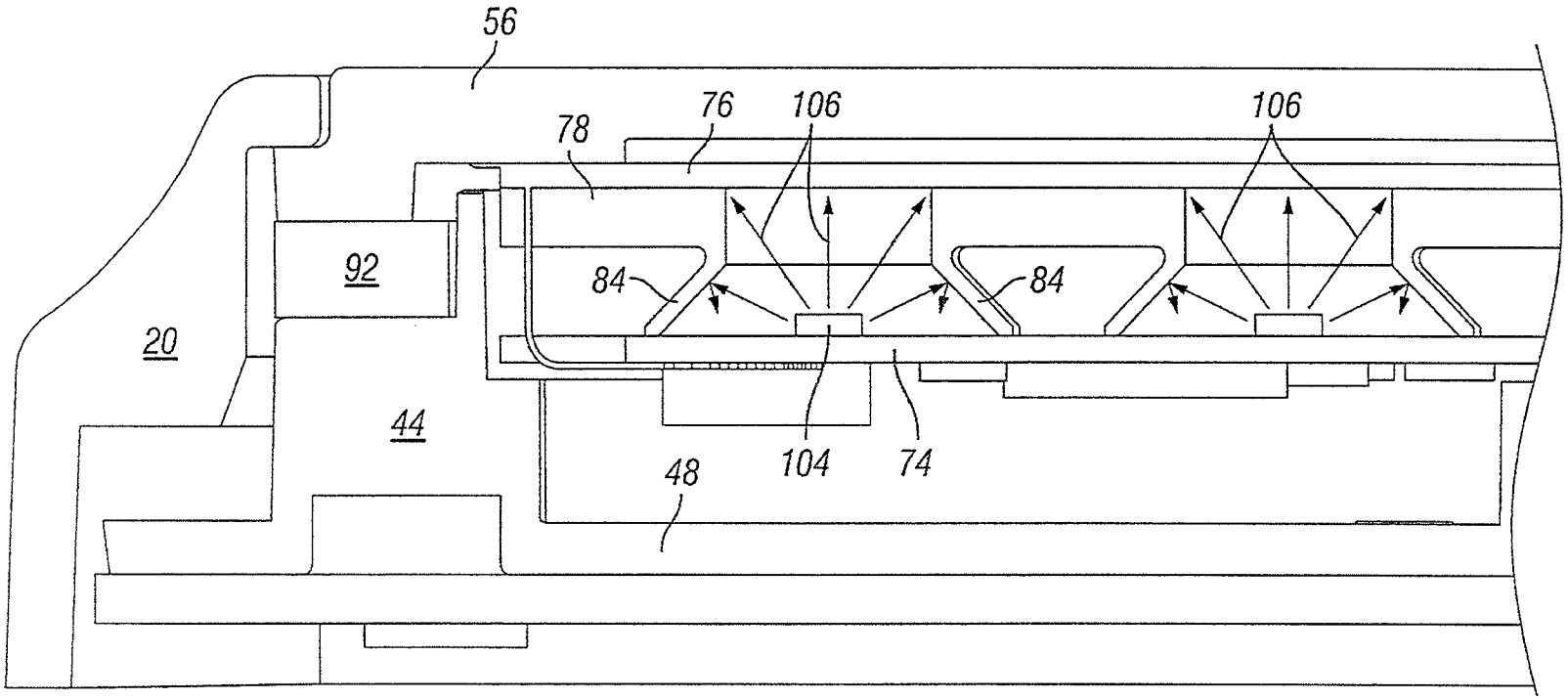
FIG. 16 is a partial cross-sectional view of the exterior assembly according to an embodiment of the disclosure.
Figure 17:
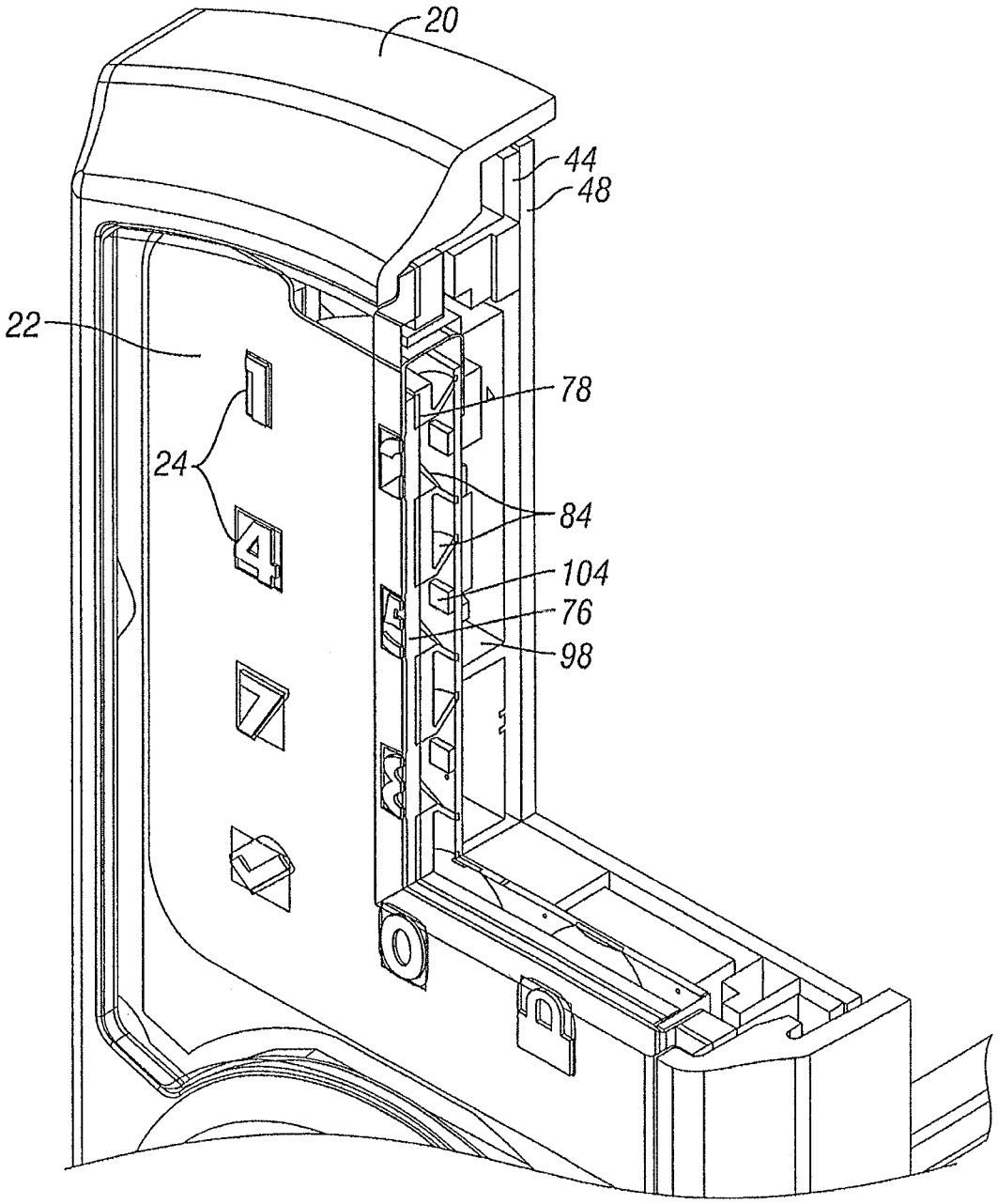
FIG. 17 is an example exterior assembly with a cut-out portion in an assembled state according to an embodiment of the disclosure.
Figure 18:
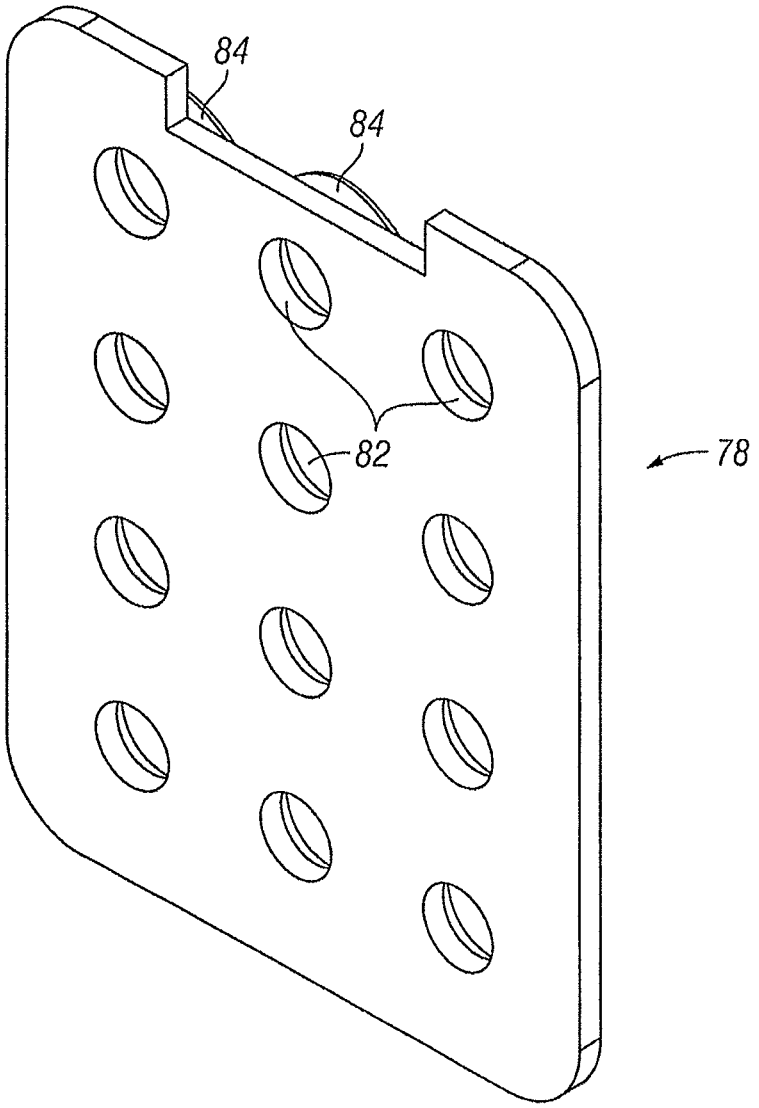
FIG. 18 is a front perspective view of an example spacer according to an embodiment of this disclosure.
Figure 19:
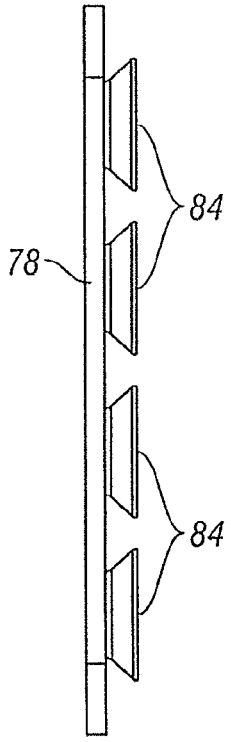
FIG. 19 is a side view of the example spacer shown in FIG. 18.
Figure 20:
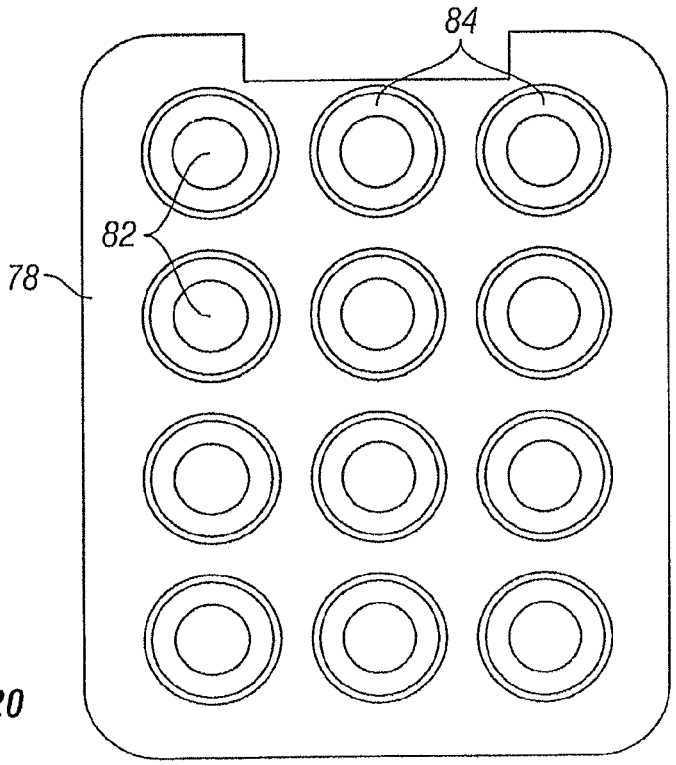
FIG. 20 is a rear view of the example spacer shown in FIG. 19.

FIG. 16 shows a cross-sectional view of a portion of the exterior assembly 10. In this view, LEDs 104 controlled by the hard PCB 74 are shown. The LEDs illuminate light, which is transmitted through the translucent diffuser 76 to illuminate the corresponding button 24 of the touch overlay 56. For example purposes, light rays 106 emanated from the LEDS are shown in FIG. 16. The opaque spacer 78 blocks light from the LEDs; however, light is able to pass through the openings 82 in the spacer 78. The light exiting the openings 82 in the spacer 78 illuminates the diffuser, which illuminates a button 24 on the touch overlay 56. As discussed above, the LEDs are arranged on the hard PCB 74 corresponding with the buttons 24 on the touch overlay 56. As discussed above, the spacer 78 has a resilient portion, which provides a spring-effect that urges the diffuser 76 towards the touch overlay 56 and urges the hard PCB 74 against the ridges 98 of the screen holder 44. In the example shown, the resilient portion is formed from flanges 84 that are flared or frustoconically-shaped. However, the resilient portion could be any structure that provides a spring-effect and this disclosure is not limited to only using flanges 84. For example, the spacer 78 could include a resilient foam portion that urges the diffuser 76 towards the touch overlay 56 and urges the hard PCB 74 against the ridges 98 of the screen holder 44. FIGS. 18 to 20 show various views of the spacer 78. The spring-effect of the flanges 84 is an important feature to urge the internal components outwardly against the touch overlay 56 and screen holder 44. As shown in FIG. 14, hard PCB 74 is urged against the ridges 98 of the screen holder 44, which makes sure there is not a gap between the hard PCB 74 and ridges 98 of the screen holder 44. This allows a resin to be applied to the opening 100 in the screen holder 44, and the ridges 98 are able to restrict flow of the resin.

EXAMPLES

Illustrative examples of the electronic lock disclosed herein are provided below. An embodiment of the electronic lock may include any one or more, and any combination of, the examples described below.

Example 1 is an electronic lock including a latch assembly including a bolt movable between an extended position and a retracted position. The lock has an interior assembly configured to move the bolt between the extended position and the retracted position. An exterior assembly is provided having a touch keypad subassembly with a surface on which touches are detected. The touch keypad subassembly defines an opening through which a wiring harness extends. The opening of the touch keypad subassembly is sealed, at least in part, by: (1) an epoxy resin and/or (2) one or more structures of the touch keypad.

In Example 2, the subject matter of Example 1 is further configured such that one or more internal structures of the touch keypad subassembly form a close-ended cavity extending from the opening in the touch keypad subassembly and the epoxy resin is located in the close-ended cavity.

In Example 3, the subject matter of Example 2 is further configured such that the epoxy resin makes the close-ended cavity substantially waterproof.

In Example 4, the subject matter of Example 2 is further configured such that the epoxy resin substantially fills the close-ended cavity.

In Example 5, the subject matter of Example 2 is further configured such that the close-ended cavity restricts flow of the epoxy resin.

In Example 6, the subject matter of Example 2 is further configured such that the close-ended cavity is formed, at least in part, by a plurality of internal ridges formed in the touch keypad subassembly.

In Example 7, the subject matter of Example 6, is further configured such that the internal ridges substantially surround the opening in the touch keypad subassembly.

In Example 8, the subject matter of Example 6 is further configured such that the touch keypad subassembly includes a touch circuit configured to detect touches on the surface and the close-ended cavity is formed, at least in part, by a portion of the touch circuit.

In Example 9, the subject matter of Example 8 is further configured such that the touch keypad subassembly includes a biasing member configured to urge at least a portion of the touch circuit in a first direction toward the internal ridges.

In Example 10, the subject matter of Example 9 is further configured such that the biasing member is configured to urge one or more internal components in a second direction generally opposite the first direction.

Example 11 is an electronic lock including a latch assembly including a bolt movable between an extended position and a retracted position. The lock includes an interior assembly configured to move the bolt between the extended position and the retracted position. An exterior assembly is provided that includes a touch keypad subassembly. The touch keypad subassembly includes a touch overlay, a touch circuit configured to detect touches on the touch overlay, a plurality of LEDs arranged to correspond with the touch areas on the touch overlay, a wiring harness configured to be electrically connected with a circuit in the interior assembly, a screen holder with a recessed area dimensioned to receive at least a portion of the touch circuit, wherein the screen holder includes an opening dimensioned to receive the wiring harness, and a diffuser assembly including a diffuser formed from a translucent material configured to diffuse light emanating from the LEDs. The diffuser assembly includes a resilient portion configured to urge at least a portion of the touch circuit towards the screen holder. The opening in the screen holder is sealed, at least in part, by: (1) an epoxy resin and/or (2) one or a combination of the touch circuit, screen holder, and diffuser assembly.

In Example 12, the subject matter of Example 11 is further configured such that the diffuser assembly includes a spacer formed from a generally opaque material disposed between the diffuser and the LEDs.

In Example 13, the subject matter of Example 12 is further configured such that the spacer includes a plurality of holes arranged to correspond with the LEDs.

In Example 14, the subject matter of Example 13 is further configured such that the spacer includes a resilient structure extending from at least a portion of the openings that urge at least a portion of the touch circuit towards the screen holder.

In Example 15, the subject matter of Example 14 is further configured such that the resilient structure is configured to urge the diffuser towards the touch overlay.

In Example 16, the subject matter of Example 11 is further configured such that the recessed area of the screen holder includes a plurality of ridges and the resilient portion of the diffuser assembly urges at least a portion of the touch circuit against the plurality of ridges to form a cavity extending from the opening in the screen holder.

In Example 17, the subject matter of Example 16 is further configured such that the cavity is configured to restrict flow of the epoxy resin.

In Example 18, the subject matter of Example 16 is further configured such that the epoxy resin is arranged in the cavity to make the cavity substantially waterproof.

Example 19 is a method of manufacturing an electronic lock. An electronic lock is provided with a touch keypad subassembly including a touch overlay, a diffuser assembly, a touch circuit and a screen holder with an opening through which a wiring harness extends. The next step is forming a close-ended cavity extending from the opening in the screen holder with at least a portion of the touch circuit. The method then seals the cavity by: (1) applying an epoxy resin and/or (2) with one or more internal structures of the touch keypad subassembly.

In Example 20, the subject matter of Example 19 is further configured such that the cavity is formed, at least in part, by biasing a portion of a touch circuit towards the screen holder.

In Example 21, the subject matter of Example 20 is further configured by biasing a second portion of the touch circuit towards the touch overlay.

In Example 22, the subject matter of Example 20 is further configured such that the screen holder includes a plurality of ridges and the step of biasing a portion of a touch circuit towards the screen holder urges the portion of the touch circuit against the plurality of ridges.

In Example 23, the subject matter of Example 22 is further configured such that resulting contact between the touch circuit and ridges restricts the flow of the resin seal to within the formed cavity.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

The invention claimed is:

1. An electronic lock comprising:

a latch assembly including a bolt movable between an extended position and a retracted position;

an interior assembly coupled to the latch assembly and configured to move the bolt between the extended position and the retracted position;

an exterior assembly coupled to the latch assembly and including a touch keypad subassembly configured to detect touches to at least a portion of a surface;

wherein the touch keypad subassembly defines an opening through which a wiring harness extends;

wherein the opening of the touch keypad subassembly is sealed, at least in part by: (1) an epoxy resin; and/or (2) one or more structures of the touch keypad subassembly; and wherein one or more internal structures of the touch keypad subassembly form a close-ended cavity extending from the opening in the touch keypad subassembly and the epoxy resin is located in the close-ended cavity.

2. The electronic lock of claim 1, wherein the epoxy resin makes the close-ended cavity substantially waterproof.

3. The electronic lock of claim 2, wherein the epoxy resin substantially fills the close-ended cavity.

4. The electronic lock of claim 1, wherein the close-ended cavity restricts flow of the epoxy resin.

5. The electronic lock of claim 1, wherein the close-ended cavity is formed, at least in part, by a plurality of internal ridges formed in the touch keypad subassembly.

6. The electronic lock of claim 5, wherein the internal ridges substantially surround the opening in the touch keypad subassembly.

7. The electronic lock of claim 5, wherein the touch keypad subassembly includes a touch circuit configured to detect touches on the surface and the close-ended cavity is formed, at least in part, by a portion of the touch circuit.

8. The electronic lock of claim 7, wherein the touch keypad subassembly includes a biasing member configured to urge at least a portion of the touch circuit in a first direction toward the internal ridges.

9. The electronic lock of claim 8, wherein the biasing member is configured to urge one or more internal components in a second direction generally opposite the first direction.

10. An electronic lock comprising:

a latch assembly including a bolt movable between an extended position and a retracted position;

an interior assembly coupled to the latch assembly and configured to move the bolt between the extended position and the retracted position;

an exterior assembly coupled to the latch assembly and including a touch keypad subassembly comprising:

a touch overlay;

a touch circuit configured to detect touches on the touch overlay;

a plurality of LEDs arranged to correspond with touch areas on the touch overlay;

a wiring harness configured to be electrically connected with a circuit in the interior assembly;

a screen holder with a recessed area dimensioned to receive at least a portion of the touch circuit, wherein the screen holder includes an opening dimensioned to receive the wiring harness;

a diffuser assembly including a diffuser formed from a translucent material configured to diffuse light emanating from the LEDs, wherein the diffuser assembly includes a resilient portion configured to urge at least a portion of the touch circuit towards the screen holder; and wherein the opening in the screen holder is sealed, at least in part, by: (1) an epoxy resin and/or (2) one or a combination of the touch circuit, screen holder and diffuser assembly.

11. The electronic lock as recited in claim 10, wherein the diffuser assembly includes a spacer formed from a generally opaque material disposed between the diffuser and the LEDs.

12. The electronic lock as recited in claim 11, wherein the spacer includes a plurality of holes arranged to correspond with the LEDs.

13. The electronic lock as recited in claim 12, wherein the spacer includes a resilient structure extending from at least a portion of the openings that urge at least a portion of the touch circuit towards the screen holder.

14. The electronic lock as recited in claim 13, wherein the resilient structure is configured to urge the diffuser towards the touch overlay.

15. The electronic lock of claim 10, wherein the recessed area of the screen holder includes a plurality of ridges and the resilient portion of the diffuser assembly urges at least a portion of the touch circuit against the plurality of ridges to form a cavity extending from the opening in the screen holder.

16. The electronic lock of claim 15, wherein the cavity is configured to restrict flow of the epoxy resin.

17. The electronic lock of claim 15, wherein the epoxy resin is arranged in the cavity to make the cavity substantially waterproof.

18. A method of manufacturing an electronic lock comprising:

providing an electronic lock with a touch keypad subassembly including a touch overlay, a diffuser assembly, a touch circuit, and a screen holder configured to receive the touch keypad assembly with the diffuser assembly and touch circuit positioned between the touch overlay and screen holder, the screen holder formed to include an opening through which a wiring harness extends;

forming a close-ended cavity extending from the opening in the screen holder with at least a portion of the touch circuit; and sealing the cavity: (1) by applying an epoxy resin; and/or (2) with one or more internal structures of the touch keypad subassembly.

19. The method of claim 18, wherein the cavity is formed, at least in part, by biasing a portion of a touch circuit towards the screen holder.

20. The method of claim 19, further comprising biasing a second portion of the touch circuit towards the touch overlay.

21. The method of claim 19, wherein the screen holder includes a plurality of ridges and the step of biasing a portion of a touch circuit towards the screen holder urges the portion of the touch circuit against the plurality of ridges.

22. The method of claim 21, wherein resulting contact between the touch circuit and ridges restricts the flow of the resin seal to within the formed cavity.

* * * * *